US010736807B2

(12) United States Patent
Leier et al.

(10) Patent No.: US 10,736,807 B2
(45) Date of Patent: Aug. 11, 2020

(54) INVERSION METHODS AND APPARATUS HAVING A COVER

(71) Applicant: EXPECTATIONS, LLC, Puyallup, WA (US)

(72) Inventors: Christopher Henry Leier, Puyallup, WA (US); Lopin Wang, Taichung (TW)

(73) Assignee: Expectations, LLC, Bonney Lake, WA (US)

( * ) Notice: Subject to any disclaimer, the term of this patent is extended or adjusted under 35 U.S.C. 154(b) by 121 days.

(21) Appl. No.: 15/927,321

(22) Filed: Mar. 21, 2018

(65) Prior Publication Data

US 2018/0271736 A1 Sep. 27, 2018

Related U.S. Application Data

(60) Provisional application No. 62/475,410, filed on Mar. 23, 2017.

(51) Int. Cl.
*A61H 1/02* (2006.01)
*A63B 21/068* (2006.01)
(Continued)

(52) U.S. Cl.
CPC ..... *A61H 1/0229* (2013.01); *A61H 1/0292* (2013.01); *A63B 21/068* (2013.01);
(Continued)

(58) Field of Classification Search
CPC .... A61H 2201/0134; A61H 2201/0138; A61H 2201/0142; A61H 2201/0149;
(Continued)

(56) References Cited

U.S. PATENT DOCUMENTS 3,081,085 A 3/1963 De Girolamo
5,188,096 A * 2/1993 Yoo ..... A61H 23/0263 601/57
(Continued)

FOREIGN PATENT DOCUMENTS

CN 2254762 Y 5/1997
CN 102949814 U 3/2013
CN 208611703 U 3/2019

OTHER PUBLICATIONS

Fastenal, "Bolted Joint Design" [online], Nov. 30, 2016, [retrieved on Aug. 21, 2019]. Retrieved from the Internet <URL:https://web.archive.org/web/20161130042621/https://www.fastenal.com/en/69/bolted-joint-design (Year: 2016).*

*Primary Examiner* — Loan B Jimenez
*Assistant Examiner* — Zachary T Moore
(74) *Attorney, Agent, or Firm* — Dicke, Billig & Czaja, PLLC

(57) ABSTRACT

An inversion apparatus includes a support frame configured to movably support an inversion table. The support frame includes a forwardly extending foot platform that helps a user mount and dismount the apparatus when the apparatus is in an operative configuration. A cover is selectively mounted on top of the inversion table to provide padding and/or a low-friction sliding surface. A lumbar support is preferably connected to the inversion table to overlie a portion of the cover.

18 Claims, 10 Drawing Sheets

(51) Int. Cl.
*A63B 26/00* (2006.01)
*A63B 21/00* (2006.01)
*A63B 24/00* (2006.01)

(52) U.S. Cl.
CPC ..... *A63B 21/4029* (2015.10); *A63B 24/0062* (2013.01); *A63B 26/00* (2013.01); *A61H 2201/0107* (2013.01); *A61H 2201/1623* (2013.01); *A61H 2201/1635* (2013.01); *A61H 2201/1642* (2013.01); *A61H 2201/5043* (2013.01); *A61H 2203/0493* (2013.01); *A61H 2205/081* (2013.01); *A63B 2209/08* (2013.01); *A63B 2225/20* (2013.01)

(58) Field of Classification Search
CPC .... A61H 2201/1619; A61H 2201/1626; A61H 2201/1623; A61H 2201/1676; A61H 2201/1253; A61H 2201/0192; A61H 2203/0481; A61H 2203/0487; A61H 2203/0493; A61H 2203/04; A61H 23/0254; A61H 24/0062; A61H 1/0229; A61H 1/0292; A63B 21/00047; A63B 21/005; A63B 21/0054; A63B 21/00185; A63B 21/4029; A63B 21/068; A63B 23/0205; A63B 23/0233; A63B 23/0211; A63B 23/0222; A63B 17/00; A63B 17/02; A63B 17/04; A63B 2225/20; A63B 2209/08; A63B 2023/006; B60N 2/58; B60N 2/60; B60N 2/5825
USPC ..... 606/201, 204; 482/142, 144
See application file for complete search history.

(56) References Cited

U.S. PATENT DOCUMENTS 5,466,205 A 11/1995 McLane et al.
7,052,448 B2 5/2006 Teeter
7,118,518 B1 10/2006 Teeter
7,125,372 B1 10/2006 Teeter et al.
D551,725 S 9/2007 Teeter
7,320,668 B1 * 1/2008 Warder ..... A61H 7/001 601/136
D581,996 S 12/2008 Teeter et al.
7,507,192 B2 3/2009 Teeter et al.
7,544,157 B2 6/2009 Teeter et al.
7,585,264 B1 9/2009 Wang et al.
7,625,326 B2 12/2009 Teeter et al.
7,625,327 B1 12/2009 Teeter et al.
7,663,653 B2 2/2010 Tsujino et al.
D617,855 S 6/2010 Leier
7,867,154 B2 1/2011 Teeter et al.
8,051,512 B2 11/2011 Teeter
D650,025 S 12/2011 Leier et al.
D650,026 S 12/2011 Leier et al.
8,075,463 B2 * 12/2011 Mills ..... A63B 23/0211 482/140
D664,220 S 7/2012 Leier et al.
8,291,533 B2 10/2012 Teeter
8,480,543 B1 7/2013 Leier et al.
8,556,787 B2 10/2013 Leier et al.
2006/0234845 A1 10/2006 Teeter et al.
2009/0054217 A1 * 2/2009 Teeter ..... A61H 1/0218 482/144
2009/0124473 A1 * 5/2009 Teeter ..... A61H 1/0218 482/144
2009/0197746 A1 8/2009 Splane, Jr. et al.
2010/0072790 A1 3/2010 Pleiman et al.
2011/0218086 A1 * 9/2011 Boren ..... A63B 26/00 482/142
2013/0059705 A1 * 3/2013 Leier ..... A61H 1/0222 482/144
2015/0202110 A1 7/2015 Leier et al.
2016/0346158 A1 12/2016 Leier et al.
2018/0147107 A1 5/2018 Leier et al.
2018/0250186 A1 9/2018 Leier et al.

* cited by examiner

INVERSION METHODS AND APPARATUS HAVING A COVER

CROSS-REFERENCE TO RELATED APPLICATION

This application claims the benefit of U.S. Provisional Application No. 62/475,410, filed Mar. 23, 2017.

FIELD OF THE INVENTION

The present invention relates to exercise equipment, and more specifically, to methods and apparatus associated with inverting a person relative to an underlying floor surface.

BACKGROUND OF THE INVENTION

Along with cardio exercise and strength exercise, stretching and/or body manipulation may be considered another fundamental form of exercise or physical fitness that is important for overall health and well being. One specific form of beneficial stretching and/or body manipulation may be accomplished by inverting one's body relative to an underlying floor surface. Some examples of known inversion apparatus are disclosed in U.S. Pat. Nos. 5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220. An object of the present invention is to provide new and improved inversion apparatus.

SUMMARY OF THE INVENTION

Generally speaking, the present invention may be described as improvements to inversion apparatus that support a user in an inverted position relative to an underlying floor surface, which may be practiced individually and/or in various combinations.

One improvement may be described in terms of a cover or pad mounted on top of a back supporting surface defined by an inversion apparatus. The back supporting surface is invertible relative to a floor engaging frame, and the cover encourages downward movement of the person's upper body when the back supporting surface is at least partially inverted.

Another improvement may be described in terms of connectors preferably inserted through apertures in the cover and openings in the table. Additional openings in the cover accommodate a lumbar support that is selectively connected to the back supporting surface. These additional openings accommodate mounting of the lumbar support in alternative locations along the back supporting surface.

In addition to defining an upwardly facing low friction surface that slidably engages a user's back, a padded version of the cover also cushions the user's back.

Yet another improvement may be described in terms of a cover or pad that is permanently mounted on top of a plastic inversion table. The cover has a peripheral edge that is inserted into a closed loop groove defined by the inversion table. The cover defines an upwardly facing low friction surface that slidably engages a user's back. A padded version of the cover also cushions a user's back. Openings may be provided in the cover to accommodate mounting a lumbar support to the back supporting surface in at least one, and preferably more than one, location along the back supporting surface.

Various features and benefits of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
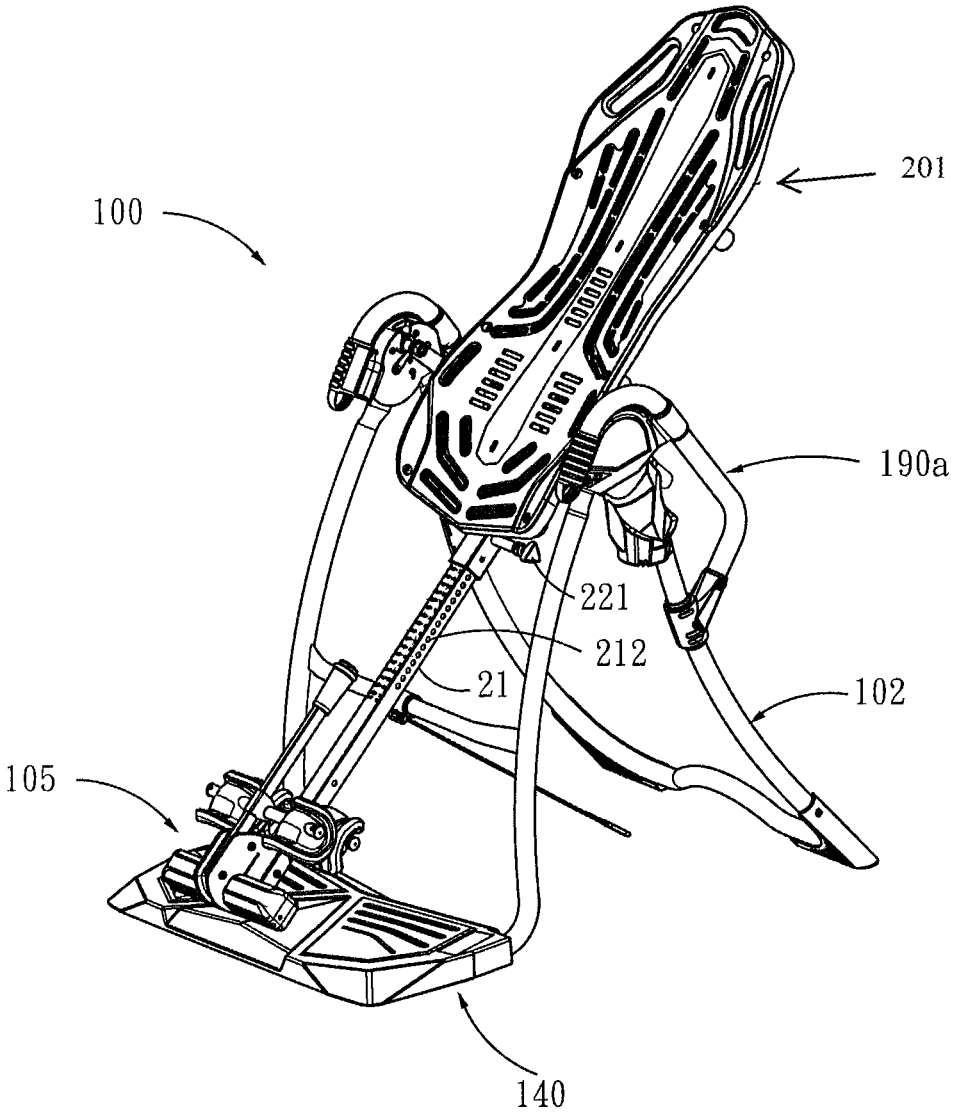
FIG. 1 is a perspective view of an inversion apparatus constructed according to the principles of the present invention.
Figure 2:
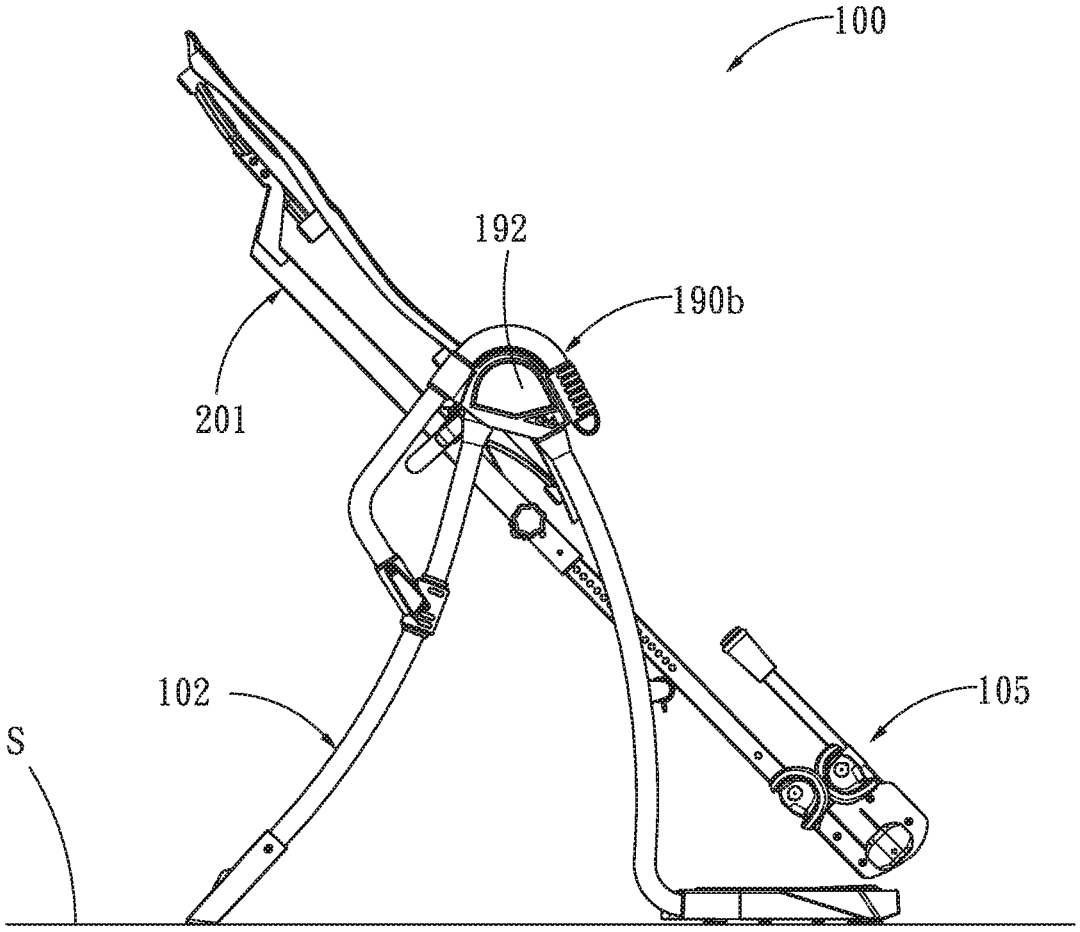
FIG. 2 is a side view of the inversion apparatus of FIG. 1.

FIGS. 1-2 show a preferred embodiment inversion apparatus 100 constructed according to the principles of the present invention. The apparatus 100 shares attributes with and/or may be implemented with components from one or more of the inversion apparatus disclosed in U.S. Pat. Nos. 5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220, all of which are incorporated herein by reference.

The inversion apparatus 100 includes a support frame 102 that pivotally supports an inversion bed or table 201 at an elevation above the floor surface S. FIGS. 1-2 show the inversion apparatus 100 in a deployed or operative configuration to support a user while pivoting through a range of orientations relative to the underlying floor surface S, from approximately upright to completely upside down. This disclosure focuses on certain features of the inversion apparatus 100 with the understanding that many features may be gleaned from the above-referenced patents.

Generally speaking, the support frame 102 is a selectively foldable A-frame preferably made of steel tubes (two of which are designated as 190*a* and 190*b*). The support frame 102 is configured to occupy a stable position relative to the underlying floor surface S, and to define a pivot axis 192, which extends perpendicular to the drawing sheet and toward the reader in FIG. 2. A foot platform 140 is preferably mounted to the front of the support frame 102 to accommodate the feet of a user prior to mounting the apparatus 100 and/or when dismounting the apparatus 100.

Figure 3:
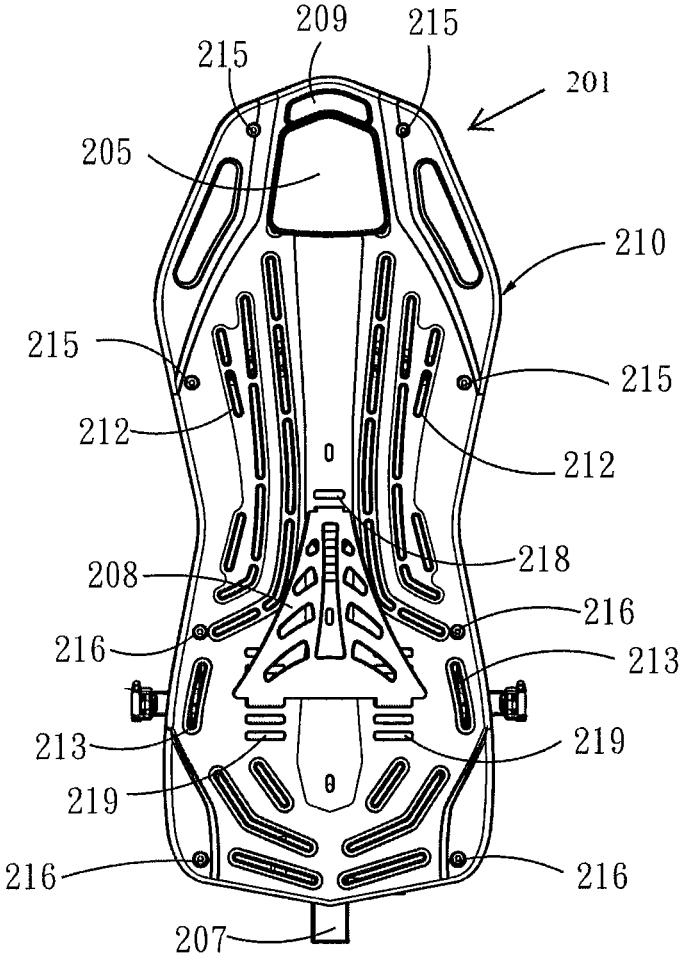
FIG. 3 is a top view of an inversion table that is part of the inversion apparatus shown in FIGS. 1-2, with an optional head pad and an optional lumbar support releasably mounted thereon.
Figure 4:
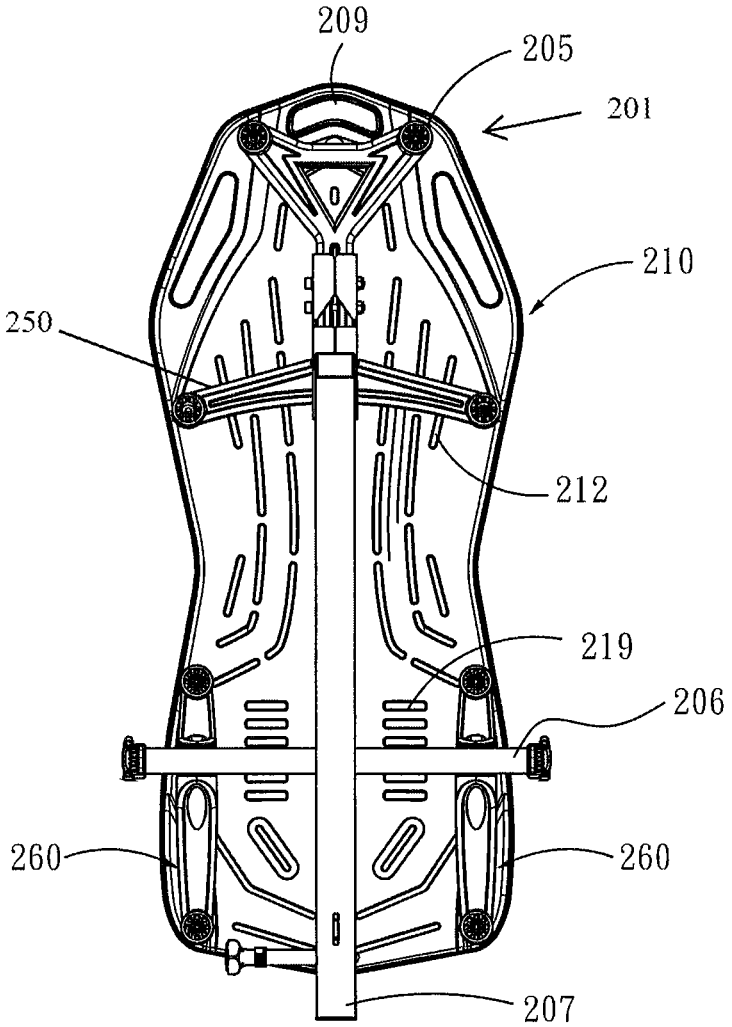
FIG. 4 is an opposite, bottom view of the inversion table of FIG. 3.

FIGS. 3-4 show and/or reference various details of the bed or table 201, which includes a body engaging platform 210 preferably made of injection molded plastic. As shown in FIG. 4, the platform 210 is supported by underlying ribs or brackets 250 and 260 (also preferably made of injection molded plastic). More specifically, four fasteners 215 insert through apertures in the upper half of the platform 210 and aligned apertures in an upper bracket 250, and four fasteners 216 insert through apertures in the lower half of the platform 210 and aligned apertures in respective left and right lower brackets 260. A cross bar 206, preferably a square steel tube, is interconnected between the left and right brackets 260, and a longitudinal bar 207, preferably a square steel tube, is interconnected between the cross bar 206 and the upper bracket 250.

With reference to FIG. 1, an extension or lower leg support 21 has an upper end that is secured inside the longitudinal bar 207 in a manner known in the art. In this regard, the upper end of the extension 21 slides or telescopes inside the bar 207, and is selectively latched in place by a spring-loaded pin or plunger assembly 221 that inserts through an aperture in the bar 207 and an aligned aperture 212 in the extension 21. The extension 21 has an opposite, lower end that supports a leg engaging assembly 105 to restrain a user's feet/ankles in a manner known in the art.

Proximate a head end or upper end of the platform 210, an opening 209 extends through the platform to provide a hand grip. Just beneath this opening 209, a head pad 205 (shown in FIG. 3) is releasably mounted on the platform 210, preferably by mounting means known in the art, such as but not limited to hook-and-loop fasteners and snap fasteners, for example. Additional left and right hand grip openings are provided along the periphery of the platform 210 to the respective left and right sides of the head pad 205.

The platform 210 is symmetrical relative to a plane extending through the longitudinal axis of the longitudinal bar 207 (and perpendicular to the drawing sheets of FIGS. 3 and 4). As shown in FIG. 3, near the center of the platform 210, laterally arranged slots 218 extend through the platform 210 (and across this plane of symmetry). Further down, laterally arranged arrays of left and right slots 219 extend through the platform 210 (on respective sides of the plane of symmetry). In a manner known in the art, the slots 219 and 218 cooperate to releasably support a lumbar bridge 208 in any of several arrangements on the platform 210. The bow or curvature of the lumbar bridge 208 is determined by distance between the slots 218 and 219 engaged by respective ends of the lumbar bridge 208. In other words, the lumbar bridge 208 must be bent to a greater extent to fit into first and second slots 218 and 219 that are relatively closer to one another.

Additional slots of various shapes and lengths extend through the platform 210 at various locations. These slots include left and right slots 212 that extend through the platform 210 proximate a lower end of the upper bracket 250, and left and right slots 213 that extend through the platform 210 proximate the upper ends of the lower brackets 260.

Figure 5:
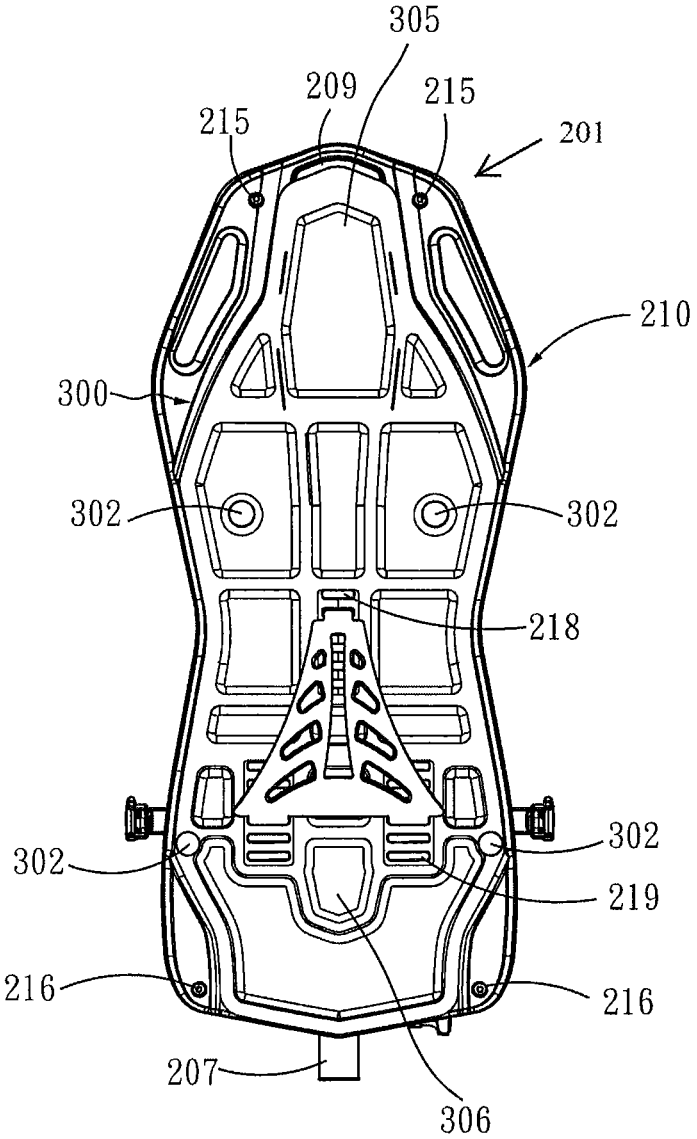
FIG. 5 is a top view of the inversion table of FIG. 3 with a cover added (and the head pad removed)
Figure 6:
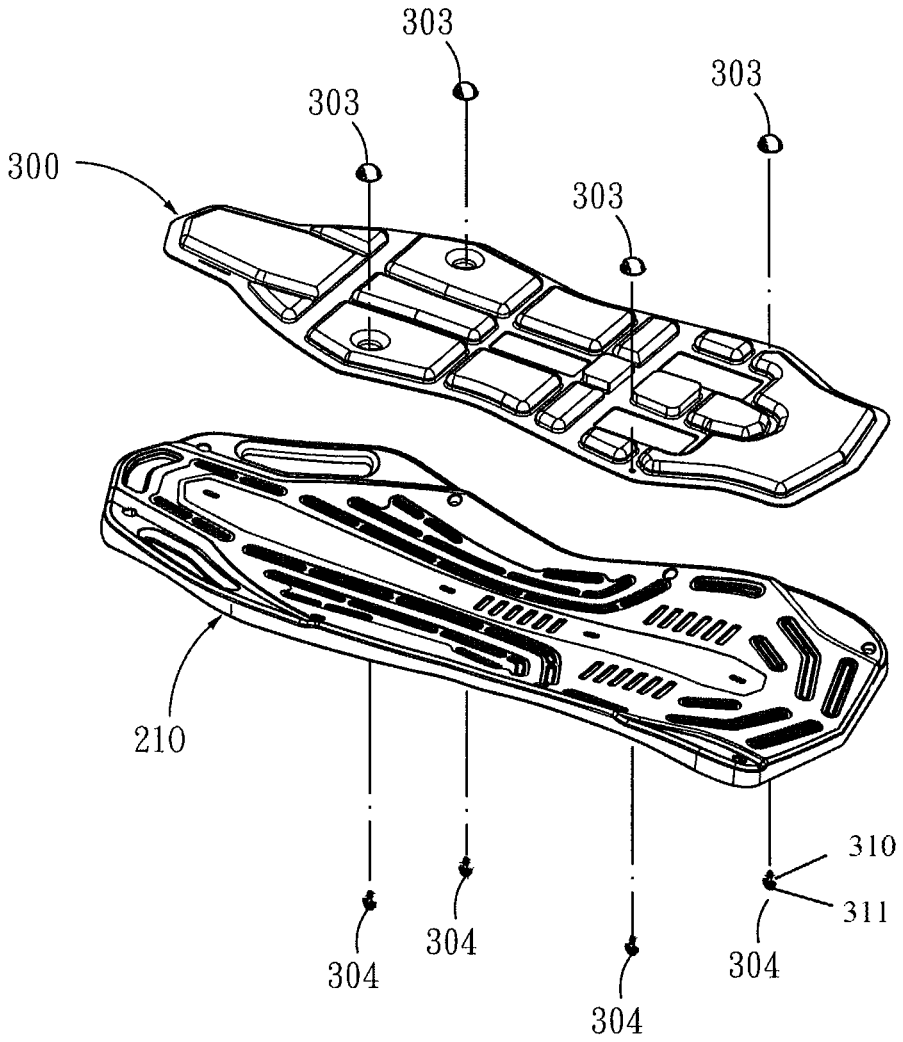
FIG. 6 is an exploded perspective view of the cover and underlying support platform shown in FIG. 5, as well as fasteners that mount the former onto the latter.

FIG. 5 shows a pad or cover or mat 300 overlying and releasably connected to the platform 210 in accordance with the principles of the present invention. Preferably, the cover 300 comprises pieces of foam trapped between upper and lower layers of a polyester fabric. The cover 300 include at least a dozen and preferably sixteen discrete cushioned sections or pads, including a head pad 305 and a tail bone pad 306. The pad 300 is selectively mounted on the platform 210 to provide a more cushioned user engaging or user facing support surface, and/or to provide a low friction surface to enhance user stretch/elongation during various degrees of inversion. Among other things, the user engaging surface of the cover 300 may be described as more slippery (relative to a user) than the upwardly facing surface of the platform 210.

Figure 7:
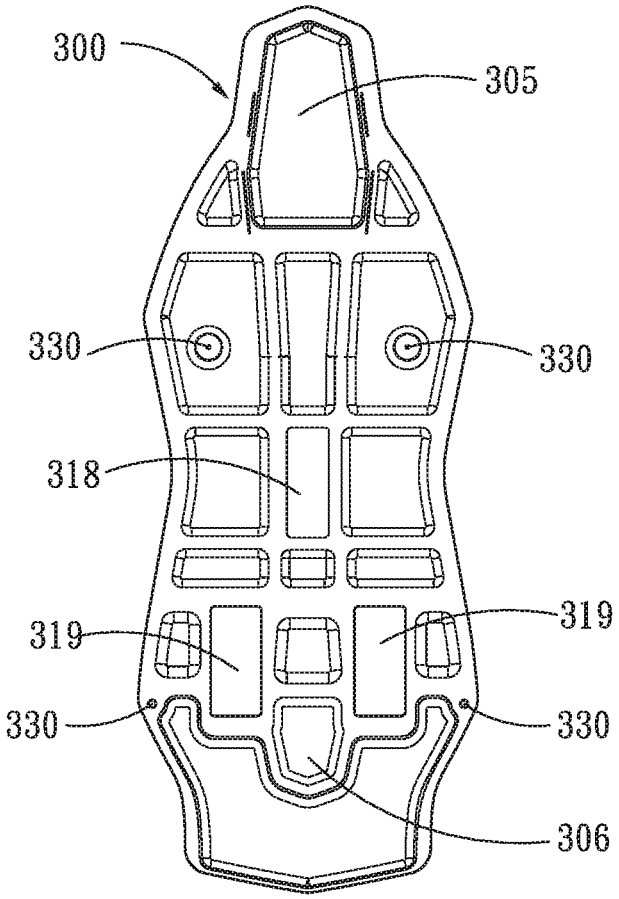
FIG. 7 is a top view of the cover shown in FIG. 6.

The cover 300 may also be described as configured and arranged to expose at least one opening in platform 210 of the supporting table 201. Three such openings in the supporting table 201 are the hand grips disposed around the head pad 205 shown in FIG. 3, including the hand grip 209. Four such openings in the supporting table 201 may be described as circular apertures 330 (see FIG. 7) and described in further detail below. More such openings in the supporting table 201 are the slots 218 and 219 that receive the lumbar support or bridge 208. In this regard, the cover 300 defines three openings 318 and 319 that align with the three sets of the slots 219 and 218 in the platform 210 to accommodate attachment of the lumbar bridge 208. The openings 318 and 319 are large enough to accommodate adjustment of the lumber bridge 208 relative to the platform 210 (and the pad 300).

The cover 300 may also be described as sized and configured to overlie a majority portion of the user facing support surface and leave a minority portion of the user facing support surface exposed. The exposed minority portion includes the regions of all the openings in the platform 210 discussed in the preceding paragraph, as well as a peripheral edge about the platform 210. Quantitatively speaking, a closed curve drawn as small as possible about the platform 210 without forming any exterior angles under 180 degrees is approximately ten percent larger in circumference than a similarly drawn closed curve about the cover 300, and this difference may alternatively be described as greater than five percent and/or between five percent and twenty percent. The difference in relative surface areas of the platform 210 and the cover 300 is relatively greater due to the openings in the platform 210 discussed in the preceding paragraph.

As shown in FIG. 5, four connectors 302 extend through respective openings in the pad 300 and respective slots 212 and 213 in the platform 210 to fasten the pad 300 to the platform 210. Each fastener 302 may be at least partially recessed within a respective cushioned section, and/or the cushioned sections may be reinforced to better endure the fasteners 302. Each preferred embodiment fastener 302 may be described as a nut and bolt assembly of a type already known in the art (and disclosed in U.S. Patent Publication No. US 2016/0346158 A1, published on Dec. 1, 2016). In this regard, the preferred embodiment nut 303 has a domed head that also functions as a massage or pressure node, and the preferred embodiment bolt 304 has a threaded shaft 310 at one end and a catch or tab 311 at an opposite end. The shaft on the bolt 304 extends upward through both a respective slot 212 or 213 in the platform 210 and an aligned aperture 330 in the cover 300, and threads into the nut 303. When the apparatus 100 is in use, the connectors 302 occupy ends of respective slots 212 and 213 in the platform 210 in a manner that prevents the cover 300 from sliding relative to the platform 210. The massage nodes 303 are relatively harder than the cushioned cover 300.

On alternative embodiments, the type of connectors and/or their position relative to slots in the platform 210 may be varied to accommodate travel of the fasteners (and the cover 300) along respective slots (and the platform 210). Further-more, the size and configuration of the slots may be varied to accommodate these different fasteners and/or particular ranges of sliding movement.

Figure 8:
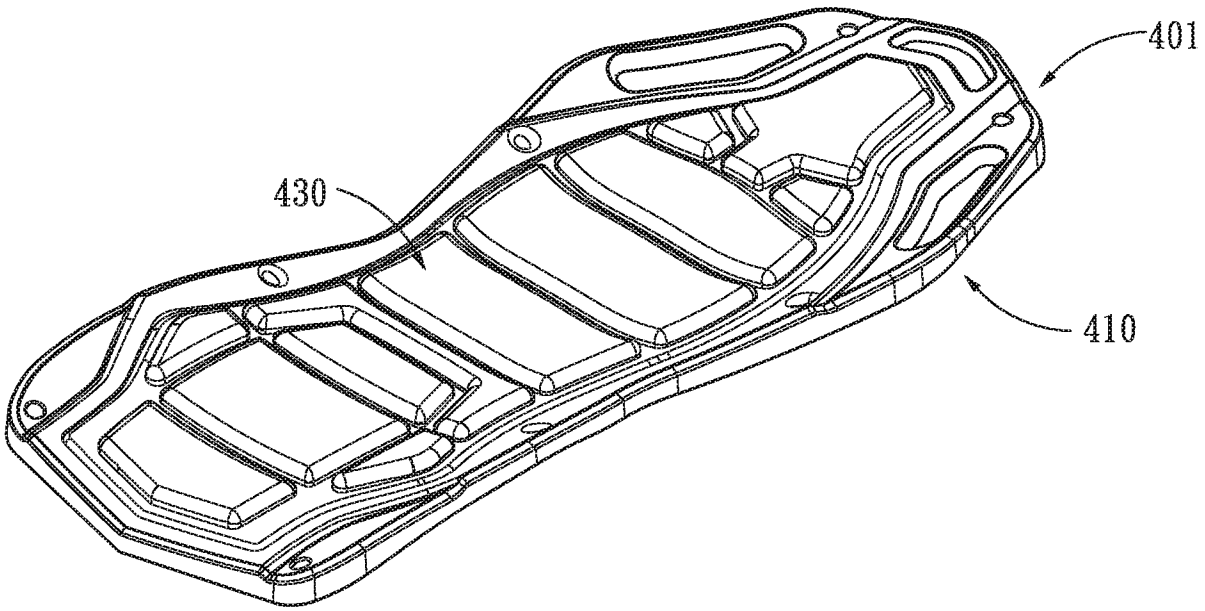
FIG. 8 is a perspective view of an alternative embodiment covered support platform that may be substituted for the components shown in FIG. 6.
Figure 9:
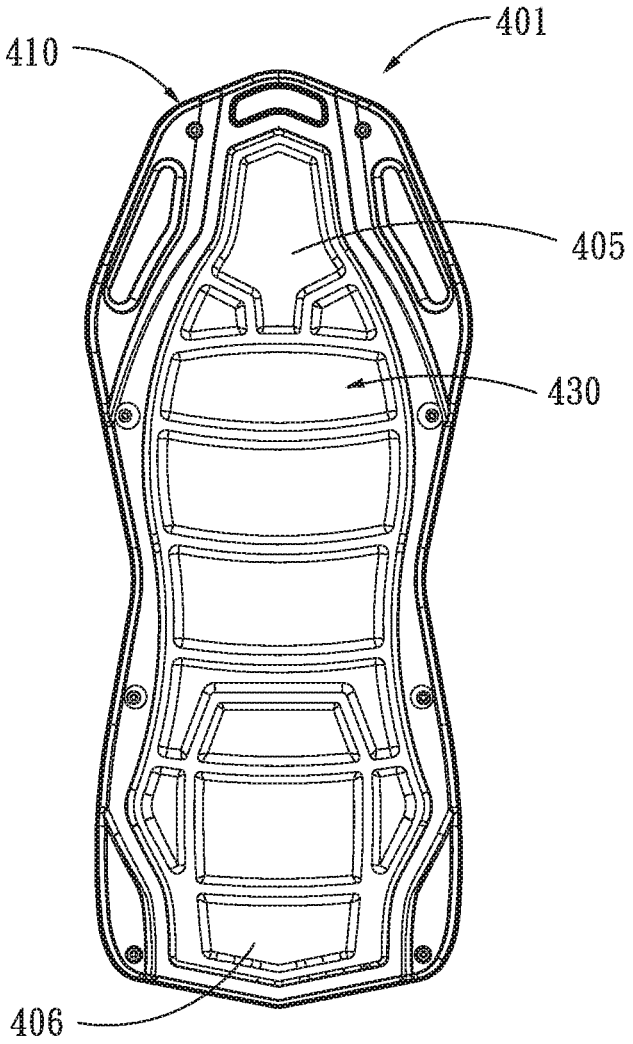
FIG. 9 is a top view of the alternative embodiment covered support platform of FIG. 8.
Figure 10:
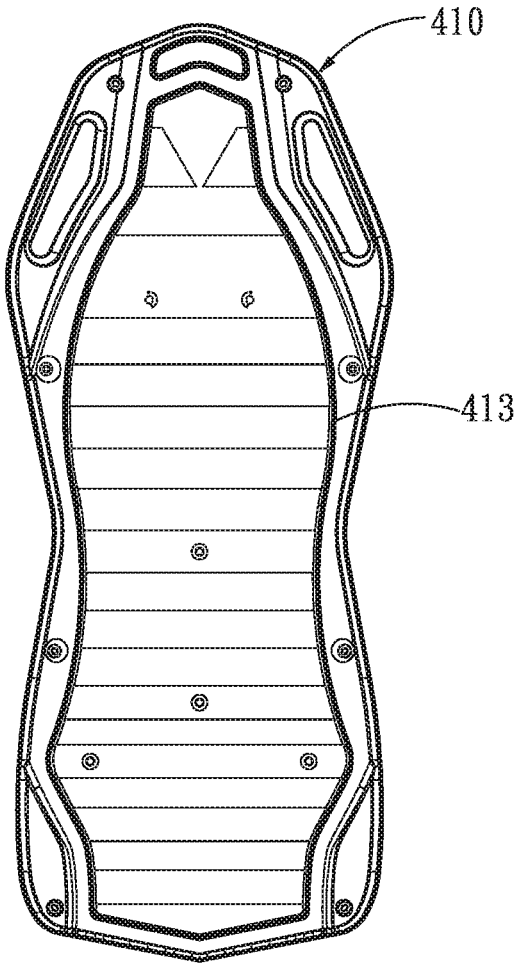
FIG. 10 is a top view of the support platform of FIG. 9 with the cover removed.

FIGS. 8-9 show an alternative embodiment platform 401 that may be substituted for the platform 210 and the cover 300 on the inversion apparatus 100. The platform 401 includes an injection molded plastic support or base 410 (shown by itself in FIG. 10) and a cover or pad or mat 430 permanently affixed to the base 410. In this regard, the pad 430 has a peripheral edge that is inserted into and secured inside a groove 413 (see FIG. 10) extending into the base 410. Securing means known in the art, including adhesives and fasteners, for example, are used to hold the pad 430 in place on the base 410. Aside from the manner of connection and the particular arrangement of foam inserts or cushions, the pad 430 is similar to the cover 300 in terms of construction, and as such, the pad 430 provides a relatively cushioned user engaging surface and/or a relatively low friction surface to enhance user stretch/elongation during various degrees of inversion. Among other things, the pad 430 may be described as providing at least twelve cushions or cushioned regions, including a head cushion 405 and an opposite end cushion 406. The platform 401 has three hand grips similar to those on the platform 210, but no corresponding structure to accommodate or receive the lumbar bridge 208. Quantitatively speaking, the size comparisons described above with reference to the platform 210 and the cover 300 apply to the components of the alternative embodiment platform 410, as well. In other words, the pad 430 covers most but less than all of the platform 410, and/or the platform 410 may be described as partially upholstered. Similarly, when the cover 300 is secured onto the platform 210, the table 201 may similarly be described as partially upholstered.

The subject invention has been described with reference to specific embodiments and particular applications with the understanding that persons skilled in the art will derive additional embodiments without departing from the scope of the subject invention. In view of the foregoing, the subject invention should be limited only to the extent of allowable claims that issue from this application or any related application.

What is claimed is:

1. An inversion apparatus that supports a user in an inverted position relative to an underlying floor surface, comprising:

a supporting stand sized and configured to occupy a stable position on an underlying floor surface;

a supporting table rotatably mounted on the supporting stand for rotation about a horizontal axis, wherein the supporting table defines at least one user facing support surface; and a cover secured to the supporting table to overlie a majority portion of the user facing support surface and leave a minority portion of the user facing support surface exposed, to directly engage a user's back during use of the apparatus; wherein the cover is configured and arranged to expose at least one opening in the supporting table, wherein the at least one opening includes a receiving aperture in the supporting table, and the cover defines an aligned aperture that aligns with the receiving aperture, and a fastener is secured to the supporting table while occupying each said aperture; wherein the fastener includes a user engaging massages node, a catch, and a relatively narrower shaft interconnected therebetween.

2. The inversion apparatus of claim 1, wherein the cover is a flexible sheet having relatively thicker portions and relatively thinner portions.

3. The inversion apparatus of claim 2, wherein the thinner portions are defined by first portions of two sheets of fabric secured flat against one another, and the thicker portions are defined by pads sandwiched between second portions of the two sheets of fabric.

4. The inversion apparatus of claim 2, wherein the cover defines at least a dozen separate thicker portions.

5. The inversion apparatus of claim 2, wherein one of the thicker portions is a head pad configured and arranged to underlie a user's head.

6. The inversion apparatus of claim 1, wherein the supporting table defines an outermost perimeter, and the at least one opening includes a slot that cooperates with a proximate portion of the outermost perimeter to define a hand grip.

7. The inversion apparatus of claim 6, wherein the supporting table extends from a foot end to a head end, and the hand grip is proximate the head end, and further comprising a foot retaining device connected to the supporting table proximate the foot end.

8. The inversion apparatus of claim 1, wherein the fastener is threaded.

9. The inversion apparatus of claim 1, wherein the fastener is releasably inserted through aligned apertures in the cover and the supporting table to releasably secure the cover to the supporting table.

10. The inversion apparatus of claim 1, wherein the user engaging massage node is relatively harder than the cover.

11. The inversion apparatus of claim 1, further comprising a lumbar support having respective end portions, wherein portions of the minority portion of the user facing support surface are exposed via openings in the cover, and the openings are configured and arranged to accommodate the respective ends portions of the lumbar support.

12. The inversion apparatus of claim 11, wherein the lumbar support overlies part of the cover and an underlying part of the majority portion of the user facing support surface.

13. The inversion apparatus of claim 1, wherein the user facing support surface defines a first outermost perimeter, and the cover defines a second outermost perimeter, and the second outermost perimeter is disposed inside the first outermost perimeter.

14. An inversion apparatus that supports a user in an inverted position relative to an underlying floor surface, comprising:

a supporting stand sized and configured to occupy a stable position on an underlying floor surface;

a supporting table rotatably mounted on the supporting stand for rotation about a horizontal axis, wherein the supporting table defines at least one user facing support surface;

a cover secured to the supporting table to overlie a majority portion of the user facing support surface and leave a minority portion of the user facing support surface exposed, to directly engage a user's back during use of the apparatus; and a lumbar support, wherein the cover defines an aligned opening that aligns with at least one opening in the supporting table, and the lumbar support is secured to the supporting table while occupying each said opening.

15. An inversion apparatus that supports a user in an inverted position relative to an underlying floor surface, comprising:

a supporting stand sized and configured to occupy a stable position on an underlying floor surface;

a supporting table rotatably mounted on the supporting stand for rotation about a horizontal axis, wherein the supporting table defines at least one user facing support surface;

a cover configured and arranged to overlie at least a portion of the user facing support surface and directly engage a user's back during use of the apparatus; and a fastener releasably inserted through aligned apertures in the cover and the supporting table to releasably secure the cover to the supporting table wherein the fastener includes a user engaging massage node, a catch, and a relatively narrower shaft interconnected therebetween.

16. The inversion apparatus of claim 15, wherein the user engaging massage node is harder than the cover.

17. An inversion apparatus that supports a user in an inverted position relative to an underlying floor surface, comprising:

a supporting stand sized and configured to occupy a stable position on an underlying floor surface;

a supporting table rotatably mounted on the supporting stand for rotation about a horizontal axis, wherein the supporting table defines at least one user facing support surface;

a cover configured and arranged to overlie at least a portion of the user facing support surface and directly engage a user's back during use of the apparatus; and a lumbar support mounted on the supporting table via aligned openings in the cover and the supporting table.

18. The inversion apparatus of claim 17, wherein the lumbar support has a first end extending through first said aligned openings, a second end extending through second said aligned openings, and an intermediate portion overlying part of the cover.

* * * * *